US009249548B1

(12) United States Patent
Mitzen et al.

(10) Patent No.: US 9,249,548 B1
(45) Date of Patent: Feb. 2, 2016

(54) APPARATUS FOR REDUCING WATER EVAPORATION AND METHOD THEREFOR

(71) Applicants: Richard Mitzen, Scottsdale, AZ (US); Thomas Johnston, Scottsdale, AZ (US)

(72) Inventors: Richard Mitzen, Scottsdale, AZ (US); Thomas Johnston, Scottsdale, AZ (US)

(73) Assignee: Resource Conservation Development, LLC, Scottsdale, AZ (US)

( * ) Notice: Subject to any disclaimer, the term of this patent is extended or adjusted under 35 U.S.C. 154(b) by 0 days.

(21) Appl. No.: 14/663,290

(22) Filed: Mar. 19, 2015

(51) Int. Cl.
*E02B 5/08* (2006.01)

(52) U.S. Cl.
CPC ..... *E02B 5/08* (2013.01)

(58) Field of Classification Search
CPC ..... E02B 5/08; E02B 5/082
See application file for complete search history.

(56) References Cited

U.S. PATENT DOCUMENTS 2,742,012 A * 4/1956 Bridges ..... B63B 35/38 114/266
3,072,920 A * 1/1963 Yellott ..... E04H 4/103 126/566
3,258,800 A * 7/1966 Robinsky ..... E01D 15/122 14/2.4
3,496,586 A * 2/1970 Kaufman ..... B63B 35/36 114/267
4,033,326 A * 7/1977 Leitner ..... F24J 2/0472 126/565
4,678,368 A * 7/1987 Helversen ..... E02B 5/08 405/118
5,483,914 A * 1/1996 Wonka ..... B63B 35/62 114/345
7,481,176 B2 * 1/2009 Pratt ..... B63B 35/34 114/264
8,210,771 B1 * 7/2012 Kim ..... E02B 5/08 405/52
2008/0317551 A1 * 12/2008 Bennett ..... E04H 4/106 405/52

* cited by examiner

*Primary Examiner* — John Kreck
(74) *Attorney, Agent, or Firm* — Weiss & Moy, P.C.; Jeffrey D. Moy

(57) ABSTRACT

A floating cover for a waterway has a plurality of tubular structures. The plurality of tubular structures is attached widthwise together and extends over an approximate width of the waterway to cover the waterway to prevent water in the waterway from evaporating.

19 Claims, 2 Drawing Sheets

APPARATUS FOR REDUCING WATER EVAPORATION AND METHOD THEREFOR

TECHNICAL FIELD

The present application in general relates to a water cover, and more specifically, to a floating water cover that may be positioned on a top surface of a water supply to reduce water evaporation from the water supply and a method therefor.

BACKGROUND

Water covers approximately 70 percent of the Earth's surface, but less than 1 percent of that water is available for human use. The world must share this small amount of usable water for agricultural, domestic, commercial, industrial, and environmental needs. Due to the small amount of water that is available for human use, water resources need to be conserved.

Water conservation may be defined as the policies, strategies and activities to preserve fresh water as a sustainable resource, to protect the water environment from pollutants, and to meet current and future human demand. Due to growing populations, increased water demands, as well as drought conditions in many areas of the world, water conservation is becoming more and more critical. Just in the U.S., over the last 50 years, the population has doubled in size. However, the demand for water over this same time period has tripled. It was recorded that at least 36 states have had at least a local, regional, or statewide water shortage, some coming even under non-drought conditions.

One way to conserve water may be to lessen the amount of water lost from open water sources due to evaporation. The amount of evaporated water from open water sources may depend on the temperature in the water and in the air, and the humidity and velocity of the air above the surface. The hotter the temperature, the drier the air and the winder the conditions, the larger the amount of water that may be lost due to evaporation. Management of water by reducing the evaporation rates may aid in the amount of water that may be used to help support the ever growing domestic, agricultural, and industrial demands.

It would thus be desirable to provide a system and method that may reduce the amount of water that evaporates from open water sources.

SUMMARY

In accordance with one embodiment, a floating cover for a waterway is disclosed. The floating cover has a plurality of tubular structures. The plurality of tubular structures is attached widthwise together and extends over an approximate width of the waterway to cover the waterway to prevent water in the waterway from evaporating.

In accordance with one embodiment, a floating cover for a waterway is disclosed. The floating cover has a plurality of tubular structures. The plurality of tubular structures is attached widthwise together and extends over an approximate width of the waterway to cover the waterway and prevent water in the waterway from evaporating. Each of the plurality of tubular structures has an upper tubular member. An end cap is attached to each end of the upper tubular member to form an airtight seal. A lower tubular member is attached lengthwise to a bottom section of the upper tubular member. The lower tubular member has open ends to allow water to flow through the lower tubular member. A plurality of connectors is used for attaching the plurality of tubular structures widthwise together. Each of the plurality of connectors has a pair of tab members. One of the pair of tab members is positioned on opposing sides of each of the plurality of upper tubular members. A connector is positioned through an opening in each of the plurality of tab members to secure adjoining tubular structures together.

In accordance with one embodiment, a floating cover for a waterway is disclosed. The floating cover has a plurality of upper tubular members coupled together widthwise to extend over an approximate width of the waterway to cover the waterway to prevent water in the waterway from evaporating. An end cap is attached to each end of each the plurality of upper tubular members to form an airtight seal. A plurality of lower tubular members is provided. Each of the plurality of lower tubular members is attached lengthwise to a bottom section of a corresponding upper tubular member of the plurality of upper tubular members. Each of the plurality of lower tubular members has open ends. A plurality of pairs of tab members is provided. At least one of the plurality of pairs of tab members is positioned on opposing sides of each of the plurality of upper tubular members. A connector is positioned through adjacent openings in adjacent tab members to secure adjoining upper tubular members together. An anchoring device is used to secure the floating cover to a bank of the waterway.

BRIEF DESCRIPTION OF THE DRAWINGS

The present application is further detailed with respect to the following drawings. These figures are not intended to limit the scope of the present application but rather illustrate certain attributes thereof.

DESCRIPTION OF THE APPLICATION

The description set forth below in connection with the appended drawings is intended as a description of presently preferred embodiments of the disclosure and is not intended to represent the only forms in which the present disclosure may be constructed and/or utilized. The description sets forth the functions and the sequence of steps for constructing and operating the disclosure in connection with the illustrated embodiments. It is to be understood, however, that the same or equivalent functions and sequences may be accomplished by different embodiments that are also intended to be encompassed within the spirit and scope of this disclosure.

Embodiments of the exemplary system and method provide for a floating cover to reduce water evaporation from open water sources. The floating cover is durable to withstand the elements. The floating cover may be formed to have a solar panel coupled to a top surface thereof to allow the floating cover to serve a dual purpose of reducing water evaporation and producing electrical power. The floating cover may be formed with a walking platform to allow one to more comfortably walk across the floating cover.

Figure 1:
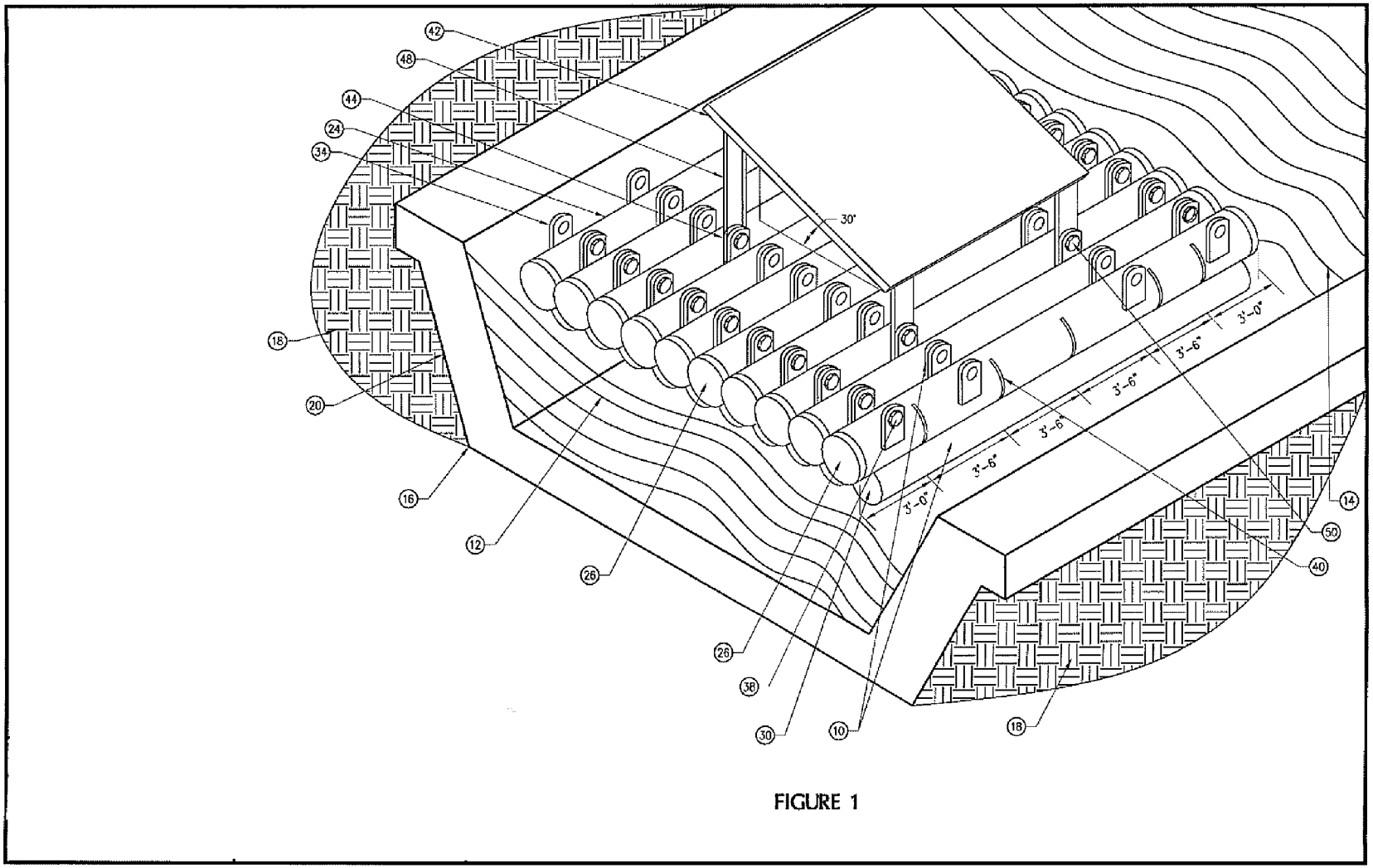
FIG. 1 is a perspective view of an exemplary floating water cover with according to one aspect of the present application.

Referring to FIG. 1, a floating cover 10 (hereinafter cover 10) is shown. The cover 10 may be positioned in a water source 12. The water source 12 may be any type of water source. In the embodiment shown in FIG. 1, the water source 12 is a canal 14, but this should not be seen in a limiting manner. The canal 14 may be formed by having a channel 16 dug within the ground 18. The channel 16 may be lined with a coating 20 such as gunite, cement or like material. The coating 20 may be used to prevent water leakage into the ground 18.

Figure 2:
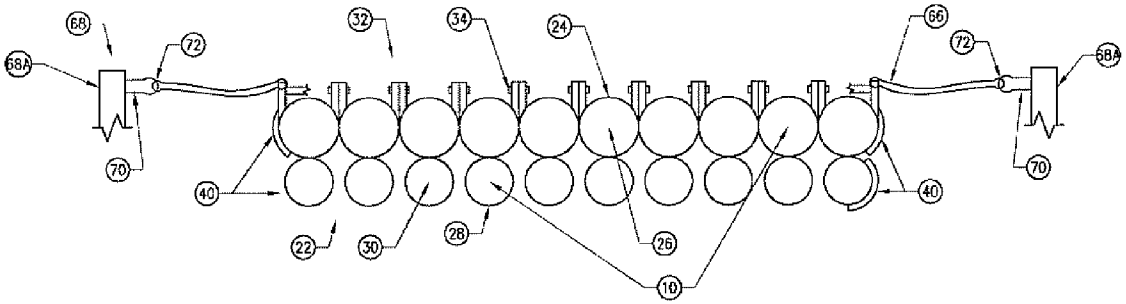
FIG. 2 is a cross-section view of the floating water cover shown in FIG. 1 showing anchor ties.
Figure 3:
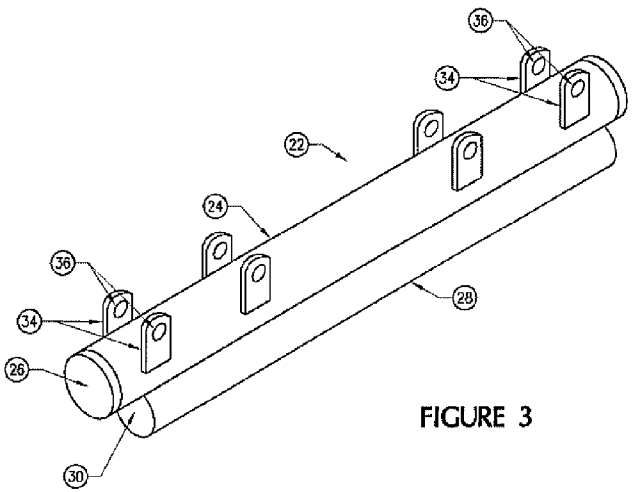
FIG. 3 is a perspective view of an individual tubular member of the floating water cover shown in FIG. 1.
Figure 5:
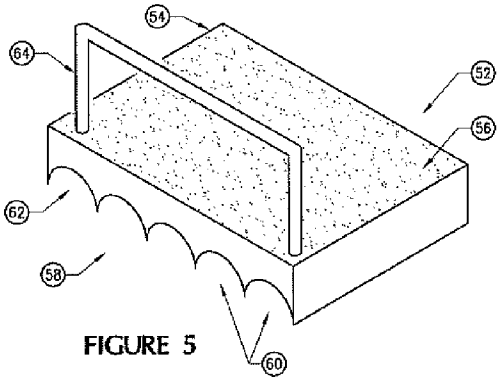
FIG. 5 is a perspective view of an exemplary platform for use with the floating water cover shown in FIG. 1.
Figure 4:
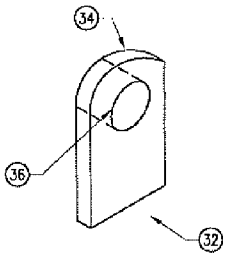
FIG. 4 is a perspective view of an individual connector used in the floating water cover shown in FIG. 1.

Referring now to FIGS. 1-3, the cover 10 may be positioned on a top surface of the water flowing in the canal 14. The cover 10 may be formed of a plurality of tubular structures 22. The tubular structures 22 may be coupled together to span the width of the canal 14. In the embodiment show, the tubular structures 22 may be coupled together width wise to span the width of the canal 14.

Each tubular structure 22 may be formed of an upper tubular member 24 and a lower tubular member 28 coupled thereto. The lower tubular member 28 may be attached to a bottom surface of the upper tubular member 24. The tubular structures 22 may be formed as a single unit. Alternatively, the lower tubular member 28 may be attached in some manner to the bottom surface of the upper tubular member 24.

The upper tubular member 24 may be a hollow member. As shown in the FIGS., the upper tubular member 24 may be cylindrical in shape. However, this is shown as an example. The upper tubular member 24 may be formed in other geometric configurations without departing from the spirit and scope of the present invention.

In accordance with one embodiment, the upper tubular member 24 may be formed of a lightweight but sturdy material. The upper tubular member 24 may be formed of a plastic material such as Polyvinyl chloride (PVC), polyethylene (PE), polypropylene (PP) or the like. Alternatively, a lightweight metal such as aluminum or tin may be used. The above are given as examples and should not be seen in a limiting manner. Other materials may be used without departing from the spirit and scope of the present invention.

End caps 26 may be positioned on each end of the upper tubular member 24. The end caps 26 may form an air tight seal thereby preventing water from entering into the upper tubular member 24 and allowing the upper tubular member 24 to float on the top surface of the water.

A lower tubular member 28 may be attached to the upper tubular member 24 as stated above. The lower tubular member 28 may be a hollow member having open ends 30. The open ends 30 may be used to allow water to flow through the lower tubular member 28. The lower tubular member 28 may be used to provide additional ballast for the cover 10 when floating on the top surface of the water. As shown in the FIGS., the lower tubular member 28 may be cylindrical in shape. However, this is shown as an example. The lower tubular member 28 may be formed in other geometric configurations without departing from the spirit and scope of the present invention. In general, the lower tubular member 28 may be formed of the same material as the upper tubular member 24. Thus, plastic material such as Polyvinyl chloride (PVC), polyethylene (PE), polypropylene (PP) or the like, or a lightweight metal such as aluminum or tin may be used.

In accordance with one embodiment, the lower tubular member 28 may be formed of a length smaller than that of the upper tubular member 24. As shown in FIG. 2, the lower tubular member 28 may be positioned on the bottom surface of the upper tubular member 24 so as to be approximately centered on the bottom surface of the upper tubular member 24. When the cover 10 is positioned in the water, the lower tubular member 28 may be completely submerged in the water, while only a bottom area of the upper tubular member 24 may be submerged.

Each tubular structure 22 may be attached to an adjoining tubular structure 22. Connectors 32 may be used to attach adjoining tubular structures 22 together. In accordance with one embodiment, connectors 32 may be formed of tab members 34. A tab member 34 may be attached to and extend up from a front section and a rear section of each tubular structure 22. In accordance with one embodiment, a tab member 34 may be attached to and extend up from both side surfaces in the front section and the rear section of each upper tubular member 24. The tab members 34 may be formed on the same material as the tubular structure 22 and may be integral to the tubular structure 22.

The tab members 34 may have an opening 36 formed through a top area of the tab member 34. When adjacent tubular structures 22 are properly positioned and aligned next to one another, the openings 36 of the tab members 34 of the adjacent tubular structures 22 may be aligned. An attachment device 38 may be portioned through the aligned openings 36 of the tab members 34 of the adjacent tubular structures 22 to secure the adjacent tubular structures 22 together. The attachment device 38 may be a nut/bolt combination, a chain, or similar linking devices.

A bumper 40 may be formed on an exterior surface of the tubular structures 22. The bumper 40 may be used to prevent damage to the tubular structure 22 caused by the tubular structures 22 bumping into the edges of the water source 12 (i.e., bumping into the gunite of the canal 14). The bumper 40 may be formed of a rubberized material such as neoprene or the like. In accordance with one embodiment, a waterproof adhesive, chemical bonding, solvent welding process or similar processes may be used to attach the bumper 40 to the tubular structures 22.

A solar panel 42 may be positioned on a top surface of the cover 10. The solar panel 42 may be used to allow the cover 10 to generate and/or store electrical energy. The solar panel 42 may be positioned on the cover 10 in different manners. For example, the solar panel 42 may be laid parallel to the top surface of the cover 10, at an angle as shown in FIG. 1, or attached using a tracking device that moves the angle of the solar panel 42 with the direction of the sun.

In the embodiment shown in FIG. 1, the solar panel 42 may be positioned at a set angle. The solar panel 42 may be attached to the cover 10 using solar cell tab member 44. The solar cell tab members 44 may extend up from a central area of one or more tubular structure 22. Support arms 48 may be attached on one end to the solar cell tab members 44 and on a second end to the solar panel 42. Connectors 50 may be used to couple the support arms 48 to the solar cell tab members 44 and to the solar panel 42.

A walkway 52 may be placed on the top surface of the cover 10. The walkway 52 may be formed of a platform 54 like structure having a planer top surface 56. The planer top surface 56 may have a rough textured surface. The bottom surface 58 may be formed to have a plurality of indentations 60. The indentations 60 may be sized and spaced to conform to the top surface of the cover 10. Thus, the indentations 60 may be formed as a plurality of semi-circular indentations 62. The semi-circular indentations 62 may be sized and spaced to conform to the plurality of upper tubular member 24 forming the top surface of the cover 10. The walkway 52 may be formed on the same material as the tubular structure 22.

A railing 64 may be attached to the walkway 52. The railing 64 may be formed on one or more sides of the walkway 52. The railing 64 may be used to aid individuals using the walkway 52 by allowing individuals to hold the railing 64 for support. The railing 64 may be formed on the same material as the tubular structure 22.

An attachment device may be used to secure the cover to the ground 18. The attachment device may be used to prevent the cover 10 from moving and/or floating away. The attachment device may be formed of a stake member 68. In accordance with one embodiment, the stake member 68 is an "L" shape stake member 68A. The "L" shape stake member 68A may be inverted and inserted into the ground 18 so that the eyebolt 70 of the "L" shape stake member 68A is positioned above the ground. The eyebolt 70 of the "L" shape stake member 68A may have an opening 72. The opening 72 may be used to secure a cable or chain 66 to a tab member 34 on one of the upper tubular members 24.

The foregoing description is illustrative of particular embodiments of the application, but is not meant to be a limitation upon the practice thereof. The following claims, including all equivalents thereof, are intended to define the scope of the application.

What is claimed is:

1. A floating cover for a waterway comprising:

a plurality of tubular structures, wherein the plurality of tubular structures is attached widthwise together and extends over an approximate width of the waterway to cover the waterway to reduce water in the waterway from evaporating; each of the plurality of tubular structures comprises:

an upper tubular member;

an end cap attached to each end of the upper tubular member to form an airtight seal; and a lower tubular member attached lengthwise to a bottom section of the upper tubular member, the lower tubular member having open ends to allow water to flow through the lower tubular member.

2. The floating cover of claim 1, comprising a plurality of connectors for attaching the plurality of tubular structures widthwise together.

3. The floating cover of claim 2, wherein the each of the plurality of connectors comprises:

a pair of tab members, wherein one of the pair of tab members is positioned on opposing sides of each of the plurality of tubular structures; and a connector positioned through an opening in each of the plurality of tab members to secure adjoining tubular structures together.

4. The floating cover of claim 1, comprising a solar panel attached to a top surface of the floating cover.

5. The floating cover of claim 1, comprising a walkway attached to a top surface of the floating cover.

6. The floating cover of claim 5, wherein the walkway comprises:

a platform having a planer top surface;

a plurality of indentations formed on a bottom surface of the platform, the indentations sized and configured to confirm to a shape of the plurality of tubular structures attached widthwise together.

7. The floating cover of claim 6, wherein the walkway comprises a railing attached to the planer top surface of the platform.

8. The floating cover of claim 1, comprising an anchor device to secure the floating cover to a bank of the waterway.

9. The floating cover of claim 8, wherein the anchor device comprises:

a stake; and a cable attached to the stake and to the floating cover.

10. A floating cover for a waterway comprising:

a plurality of tubular structures, wherein the plurality of tubular structures is attached widthwise together and extend over an approximate width of the waterway to cover the waterway to reduce water in the waterway from evaporating, wherein each of the plurality of tubular structures comprises:

a upper tubular member, an end cap attached to each end of the upper tubular member to form an airtight seal; and a lower tubular member attached lengthwise to a bottom section of the upper tubular member, the lower tubular member having open ends to allow water to flow through the lower tubular member;

a plurality of connectors for attaching the plurality of tubular structures widthwise together, wherein each of the plurality of connectors comprises:

a pair of tab members, wherein one of the pair of tab members is positioned on opposing sides of each of the plurality of upper tubular members; and a connector positioned through an opening in each of the plurality of tab members to secure adjoining tubular structures together.

11. The floating cover of claim 10, comprising a solar panel attached to a top surface of the floating cover.

12. The floating cover of claim 10, comprising a walkway attached to a top surface of the floating cover.

13. The floating cover of claim 12, wherein the walkway comprises:

a platform having a planer top surface having a rough texture;

a plurality of indentations formed on a bottom surface of the platform, the indentations sized and configured to confirm to a shape of the plurality of tubular structures attached widthwise together.

14. The floating cover of claim 13, wherein the walkway comprises a railing attached to the planer top surface of the platform.

15. The floating cover of claim 10, comprising an anchor device to secure the floating cover to a bank of the waterway.

16. The floating cover of claim 15, wherein the anchor device comprises:

a stake; and a cable attached to the stake and to the floating cover.

17. A floating cover for a waterway comprising:

a plurality of upper tubular members coupled together widthwise to extend over an approximate width of the waterway to cover the waterway to prevent water in the waterway from evaporating;

an end cap attached to each end of each the plurality of upper tubular members to form an airtight seal;

a plurality of lower tubular members, wherein each of the plurality of lower tubular members is attached lengthwise to a bottom section of a corresponding upper tubular member of the plurality of upper tubular members, each of the plurality of lower tubular members having open ends;

a plurality of pairs of tab members, wherein at least one of the plurality of pairs of tab members is positioned on opposing sides of each of the plurality of upper tubular members;

a connector positioned through adjacent openings in adjacent tab members to secure adjoining upper tubular members together; and an anchoring device to secure the floating cover to a bank of the waterway.

18. The floating cover of claim 17, comprising a solar panel attached to a top surface of the floating cover.

19. The floating cover of claim 17, comprising a walkway attached to a top surface of the floating cover, wherein the walkway comprises:

a platform having a planer top surface, the planer top surface being textured;

a plurality of indentations formed on a bottom surface of the platform, the indentations sized and configured to confirm to a shape of the plurality of upper tubular members attached widthwise together.

* * * * *